US007394306B2

(12) United States Patent
Chen

(10) Patent No.: US 7,394,306 B2
(45) Date of Patent: Jul. 1, 2008

(54) REGULATOR CIRCUIT

(75) Inventor: Yin-Chang Chen, Hsinchu County (TW)

(73) Assignee: eMemory Technology Inc., Hsinchu (TW)

( * ) Notice: Subject to any disclaimer, the term of this patent is extended or adjusted under 35 U.S.C. 154(b) by 75 days.

(21) Appl. No.: 11/309,075

(22) Filed: Jun. 16, 2006

(65) Prior Publication Data

US 2007/0164810 A1 Jul. 19, 2007

(30) Foreign Application Priority Data

Jan. 16, 2006 (TW) ..... 95101556 A

(51) Int. Cl.
*G05F 1/10* (2006.01)
*G05F 3/02* (2006.01)
*G05F 3/16* (2006.01)

(52) U.S. Cl. ..... 327/541; 327/540; 327/538; 327/543; 323/273; 323/316; 323/315; 323/280

(58) Field of Classification Search ..... 327/540, 327/541, 548, 543
See application file for complete search history.

(56) References Cited

U.S. PATENT DOCUMENTS

| | | | | |
|---|---|---|---|---|
| 5,686,824 | A * | 11/1997 | Rapp | 323/313 |
| 6,600,692 | B2 | 7/2003 | Tanzawa | 365/226 |
| 6,888,340 | B1 | 5/2005 | Chen | 323/316 |
| 7,176,752 | B2 * | 2/2007 | Hashimoto | 327/541 |

* cited by examiner

*Primary Examiner*—N. Drew Richards
*Assistant Examiner*—Daniel Rojas
(74) *Attorney, Agent, or Firm*—Jianq Chyun IP Office

(57) ABSTRACT

A regulator circuit having a voltage output terminal is provided. The regulator circuit includes a current mirror module, a plurality of source followers, and a switch. The current module receives a driving voltage, and has a first current terminal coupled to a driving current and a plurality of second current terminals, so that the driving current is copied to each second current terminal. Furthermore, each of second current terminals is coupled to one of source followers respectively. An output terminal of each source follower is coupled to an input terminal of next source, and the input terminal of the first source follower receives a control voltage. So that the source followers can determine whether the switch conducts the driving voltage to the voltage output terminal or not according to the copied driving current and the control voltage.

15 Claims, 5 Drawing Sheets

REGULATOR CIRCUIT

CROSS-REFERENCE TO RELATED APPLICATION

This application claims the priority benefit of Taiwan application serial no. 95101556, filed on Jan. 16, 2006. All disclosure of the Taiwan application is incorporated herein by reference.

BACKGROUND OF THE INVENTION

1. Field of the Invention

The present invention relates to a regulator circuit. More particularly, the present invention relates to a regulator circuit for non-volatile memory.

2. Description of Related Art

The data stored in an Electrically Erasable Programmable Read-Only Memory (EEPROM) is retained even when the power is removed. The EEPROM can be directly written or erased with electronic signals if a user wants to write or erase the content stored in the EEPROM. For example, with a regulator of an internal voltage generating device, a plurality of stable and constant reference voltages are provided based on an output voltage of the boost circuit of the regulator, and the reference voltages are inputted to the EEPROM for writing or erasing data.

FIG. 1 is a circuit diagram of a positive voltage regulator described in the patent specification "Semiconductor Device with a Voltage Regulator" of U.S. Pat. No. 6,600,692 B2. Referring to FIG. 1, the positive voltage regulator 23 includes a driver 1 and a voltage-dividing circuit 2. Wherein, the driver 1 has transistors QP2 and QN2 coupled in series to an output node N0 connected to the internal voltage generating circuit, and the driver 1 outputs a regulating voltage Vreg at the output node N0. There are a pull-up current Iup through the transistor QP2 and a pull-down current Idn through the transistor QN2. Besides, the gates of the transistors QP2 and QP1 are coupled with each other to form a current mirror, and the sources of the transistors QP2 and QP1 are coupled to a boost voltage output node 80 to receive a boost voltage Vpp. The drain of the transistor QP1 is coupled to the drain of the transistor QN1, and the sources of the transistors QN1 and QN2 are both grounded voltage Vss.

The positive voltage regulator 23 further includes operational amplifiers OP1 and OP2. Wherein, the reversed-phase input terminal of the operational amplifier OP1 and the normal-phase input terminal of the operational amplifier OP2 are coupled to the reference voltage generating device 22. The reference voltage generating device 22 provides a reference voltage Vref1 to the reversed-phase input terminal of the operational amplifier OP1 and a reference voltage Vref2 to the normal-phase input terminal of the operational amplifier OP2. Wherein, the reference voltage Vref1 is greater than the reference voltage Vref2. In addition, the operational amplifiers OP1 and OP2 also receive a regulator enabling signal REGE. The output terminal of the operational amplifier OP1 is coupled to the gate of the transistor QN2, and meanwhile, the output terminal of the operational amplifier OP2 is coupled to the gate of the transistor QN1.

On the other hand, the voltage-dividing circuit 2 has resistors R1, R2, and R3 and transistors QN3 and QN4. Wherein, the resistors R1 and R2 are connected in series to node N1. The gate of the transistor QN3 is coupled to a verify-read control signal VRFY, the source thereof is coupled to the ground voltage Vss, and the drain thereof is coupled to node N3. Meanwhile, the gate of the transistor QN4 is coupled to a write control signal PROG, and the drain thereof is coupled to node N2. The voltage-dividing circuit 2 divides the regulating voltage Vreg and inputs the voltage on node N1 to the normal-phase input terminal of the operational amplifier OP1 and the reversed-phase input terminal of the operational amplifier OP2, so that the regulating voltage Vreg is feedbacked to driver 1 for maintaining the quantity of the regulating voltage Vreg.

FIG. 2 is a circuit diagram of a negative voltage regulator described in the patent specification "Semiconductor Device with a Negative Voltage Regulator" of U.S. Pat. No. 6,888,340 B1. Referring to FIG. 2, the semiconductor device 200 has a negative voltage regulator 20, which includes a voltage regulator 210, a current source circuit 220, a reference voltage generator 230, a voltage divider 240, a driver 250, and operational amplifiers 261 and 262. Wherein, the voltage regulator 210 regulates a voltage source $V_{DD}$, and the voltage regulator 210 has a transistor p3 and an operational amplifier 263. The drain of the transistor p3 and the normal-phase input terminal of the operational amplifier 263 are both coupled to node Ns. In addition, the reference voltage generator 230 generates and outputs a reference voltage $V_{ref}$21 to the reversed-phase input terminal of the operational amplifier 263 and a reference voltage $V_{ref}$ 22 to the reversed-phase input terminal of the operational amplifier 261 and the normal-phase input terminal of the operational amplifier 262.

The current source circuit 220 has the transistors n1 and n2. The sources of the transistors n1 and n2 are both coupled to node $N_{IN}$, and a negative input voltage $V_{IN}$2 is inputted to the negative voltage regulator 20 at node $N_{IN}$. Besides, the voltage divider 240 has resistors R21 and R22, wherein one terminal of the resistors R21 and one terminal of the resistor R22 are both coupled to node $N_{FEBK}$3, and node $N_{FEBK}$3 is electrically coupled to the normal-phase input terminal of the operational amplifier 261 and the reversed-phase input terminal of the operational amplifier 262. The other terminal of the resistor R21 is coupled to the normal-phase input terminal of the operational amplifier 263, and the other terminal of the resistor R22 is coupled to node $N_{OUT}$, which carries a negative output voltage $V_{OUT}$2.

Moreover, the driver 250 has transistors p1 and p2, wherein the gates of the transistors p1 and p2 are respectively coupled to the output terminal of the operational amplifier 261 and the output terminal of the operational amplifier 262.

It can be understood from FIG. 1 that the level of the regulating voltage Vreg is easily affected by the outputs of the operational amplifiers OP1 and OP2. In other words, the quantity of the regulating voltage $V_{reg}$ is limited by the output level of the operational amplifiers OP1 and OP2. Similarly, in FIG. 2, the quantity of the negative output voltage $V_{OUT}$2 is also limited by the output level of the operational amplifiers 261 and 262. Thus, the range of the output voltage of a conventional circuit is limited.

SUMMARY OF THE INVENTION

Accordingly, the present invention is directed to provide a regulator circuit, which, compared with conventional technologies, can provide a wider range of stable output voltage while writing or erasing an EEPROM.

The present invention provides a regulator circuit having a voltage output terminal, and the regulator circuit includes a current mirror module, a plurality of source followers, and a switch. Wherein, the current module receives a driving voltage and has a first current terminal coupled to a driving current and a plurality of second current terminals, so that the driving current is copied to each second current terminal.

Furthermore, each of second current terminals is coupled to one of source followers respectively. An output terminal of each source follower is coupled to an input terminal of next source and the input terminal of the first source follower receives a control voltage. So that the source followers can determine whether the switch conducts the driving voltage to the voltage output terminal or not according to the copied driving current and the control voltage.

In another aspect, the present invention provides a regulator circuit having a voltage output terminal, and the regulator circuit includes a voltage source module, a current mirror module, an output module, a first PMOS transistor, a second PMOS transistor, and a third PMOS transistor. Wherein, the voltage source module provides a driving voltage, and the current mirror module receives the driving voltage. The current mirror module has a first current terminal, a second current terminal, and a third current terminal, wherein the first current terminal is coupled to a driving current, and the driving current is copied to the second and the third current terminals. Besides, the output module is coupled to the voltage output terminal and generates a first control voltage and a second control voltage according to the voltage level of the voltage output terminal. In addition, the source of the first PMOS transistor is coupled to the second current terminal, the drain thereof is coupled to the ground, and the gate thereof receives the first control voltage. Moreover, the source of the second PMOS transistor is coupled to the third current terminal, the drain thereof is coupled to the ground, and the gate thereof is coupled to the source of the first PMOS transistor. Furthermore, the source of the third PMOS transistor receives the driving voltage, the gate thereof is coupled to the third current terminal, and the drain thereof is coupled to the output module and the voltage output terminal.

In an embodiment of the present invention, the output module includes a first operational amplifier, a second operational amplifier, and a NMOS transistor. Wherein, the first operational amplifier generates a first control voltage, the negative input terminal of the first operational amplifier receives a reference voltage, the output terminal thereof is coupled to the gate of the first PMOS transistor, and the positive input terminal thereof is coupled to the ground through a first resistor and to the voltage output terminal through a second resistor. The negative input terminal of the second operational amplifier receives the reference voltage, the positive input terminal thereof is coupled to the positive input terminal of the first operational amplifier, and the output terminal of the second operational amplifier outputs a second control voltage. The gate of the NMOS transistor receives the second control voltage, the source thereof is coupled to the ground, and the drain thereof is coupled to the drain of the third PMOS transistor and to the voltage output terminal.

In addition, in an embodiment of the present invention, the current mirror module includes a fourth PMOS transistor, a fifth PMOS transistor, and a sixth PMOS transistor. Wherein, the source of the fourth PMOS transistor receives a driving voltage, and the gate and the drain thereof are coupled with each other and to the first current terminal. The source and the gate of the fifth PMOS transistor are respectively coupled to the source and the gate of the fourth PMOS transistor, and the drain thereof is coupled to the second current terminal. The source and the gate of the sixth PMOS transistor are respectively coupled to the source and the gate of the fourth PMOS transistor, and the drain thereof is coupled to the third current terminal.

Moreover, in an embodiment of the present invention, the voltage source module includes an oscillator, a clock generator, and a positive voltage pump. Wherein, the oscillator generates an oscillating signal, the clock generator generates a clock signal according to the oscillating signal, and the positive voltage pump generates a positive driving voltage according to the clock signal.

The present invention further provides a regulator circuit having a voltage output terminal, and the regulator circuit includes a voltage source module, a current mirror module, an output module, a first NMOS transistor, a second NMOS transistor, and a third NMOS transistor. Wherein, the voltage source module provides a driving voltage, and the current mirror module receives the driving voltage. The current mirror module has a first current terminal, a second current terminal, and a third current terminal, wherein the first current terminal receives a driving current, and the driving current is copied to the second and the third current terminals. The output module is coupled to the voltage output terminal and generates a first control voltage and a second control voltage according to the voltage level of the voltage output terminal. The drain of the first NMOS transistor is coupled to a common voltage, the gate thereof receives the first control voltage, and the source thereof is coupled to the second current terminal. The drain of the second NMOS transistor is coupled to the common voltage, the source thereof is coupled to the third current terminal, and the gate thereof is coupled to the source of the first NMOS transistor and the second current terminal. The source of the third NMOS transistor receives the driving voltage, the gate thereof is coupled to the third current terminal, and the drain thereof is coupled to the output module and the voltage output terminal.

In another embodiment of the present invention, the output module of the regulator circuit includes a first operational amplifier, a second operational amplifier, and a PMOS transistor. Wherein, the first operational amplifier generates a first control voltage, the negative input terminal of the first operational amplifier receives a reference voltage, the output terminal thereof is coupled to the gate of the first NMOS transistor, and the positive input terminal thereof is coupled to a common voltage through a first resistor and to the voltage output terminal through a second resistor. The negative input terminal of the second operational amplifier receives a reference voltage, the positive input terminal thereof is coupled to the positive input terminal of the first operational amplifier, and the output terminal thereof outputs a second control voltage. The gate of the PMOS transistor receives the second control voltage, the source thereof is coupled to the common voltage, and the drain thereof is coupled to the drain of the third NMOS transistor and to the voltage output terminal.

In addition, the current mirror module includes a fourth NMOS transistor, a fifth NMOS transistor, and a sixth NMOS transistor. Wherein, the source of the fourth NMOS transistor is coupled to the driving voltage, the gate and the drain thereof are coupled with each other and to the first current terminal. The source and the gate of the fifth NMOS transistor are respectively coupled to the source and the gate of the fourth NMOS transistor, and the drain thereof is coupled to the second current terminal. The source and the gate of the sixth NMOS transistor are respectively coupled to the source and the gate of the fourth NMOS transistor, and the drain thereof is coupled to the third current terminal.

Moreover, in another embodiment of the present invention, the voltage source module of the regular circuit includes an oscillator, a clock generator, and a negative voltage pump. Wherein the oscillator generates an oscillating signal, the clock generator generates a clock signal according to the oscillating signal, and the negative voltage pump generates a negative driving voltage according to the clock signal.

In order to make the aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
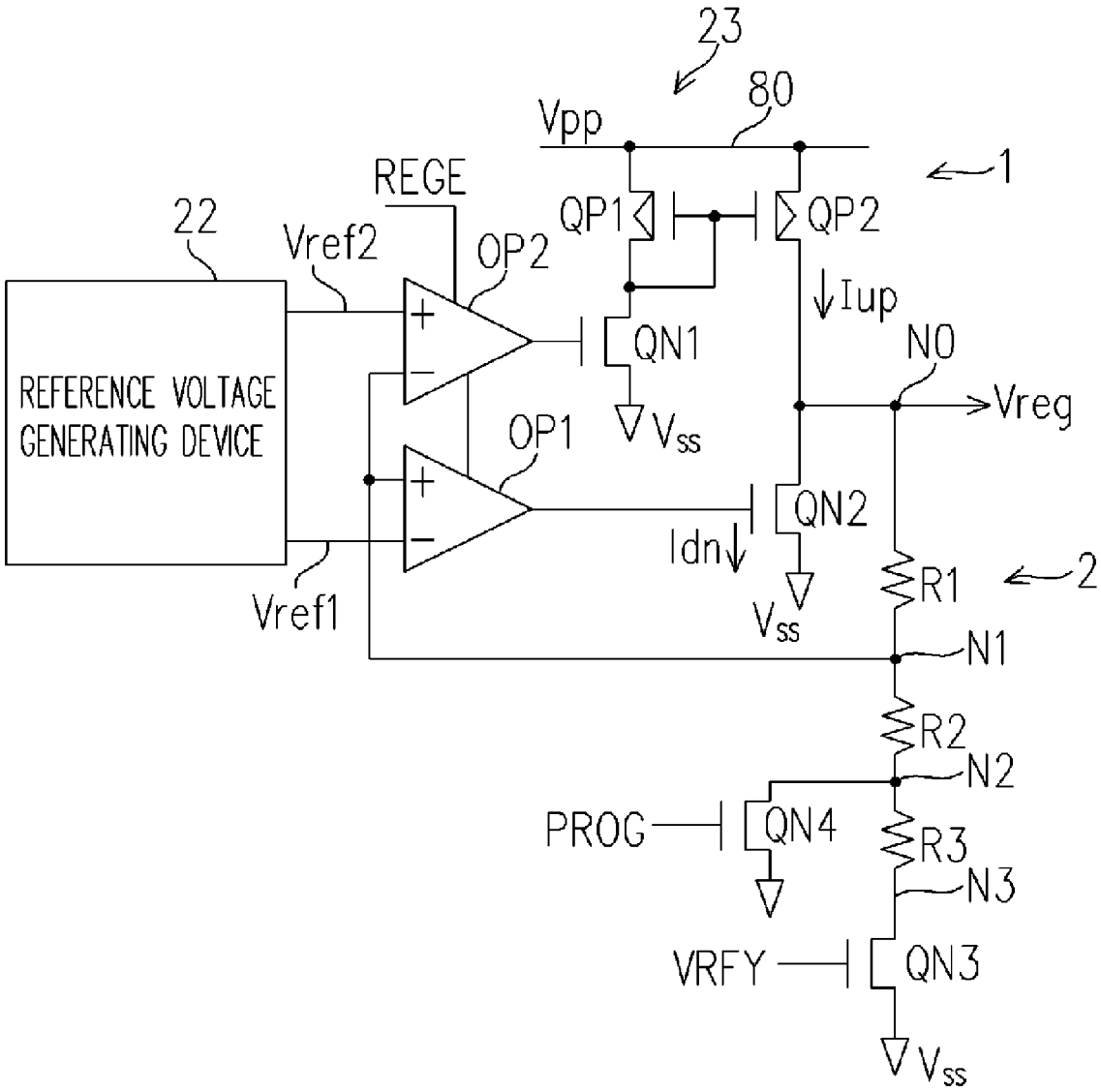
FIG. 1 (PRIOR ART)
FIG. 1 is a circuit diagram of a positive voltage regulator.
Figure 2:
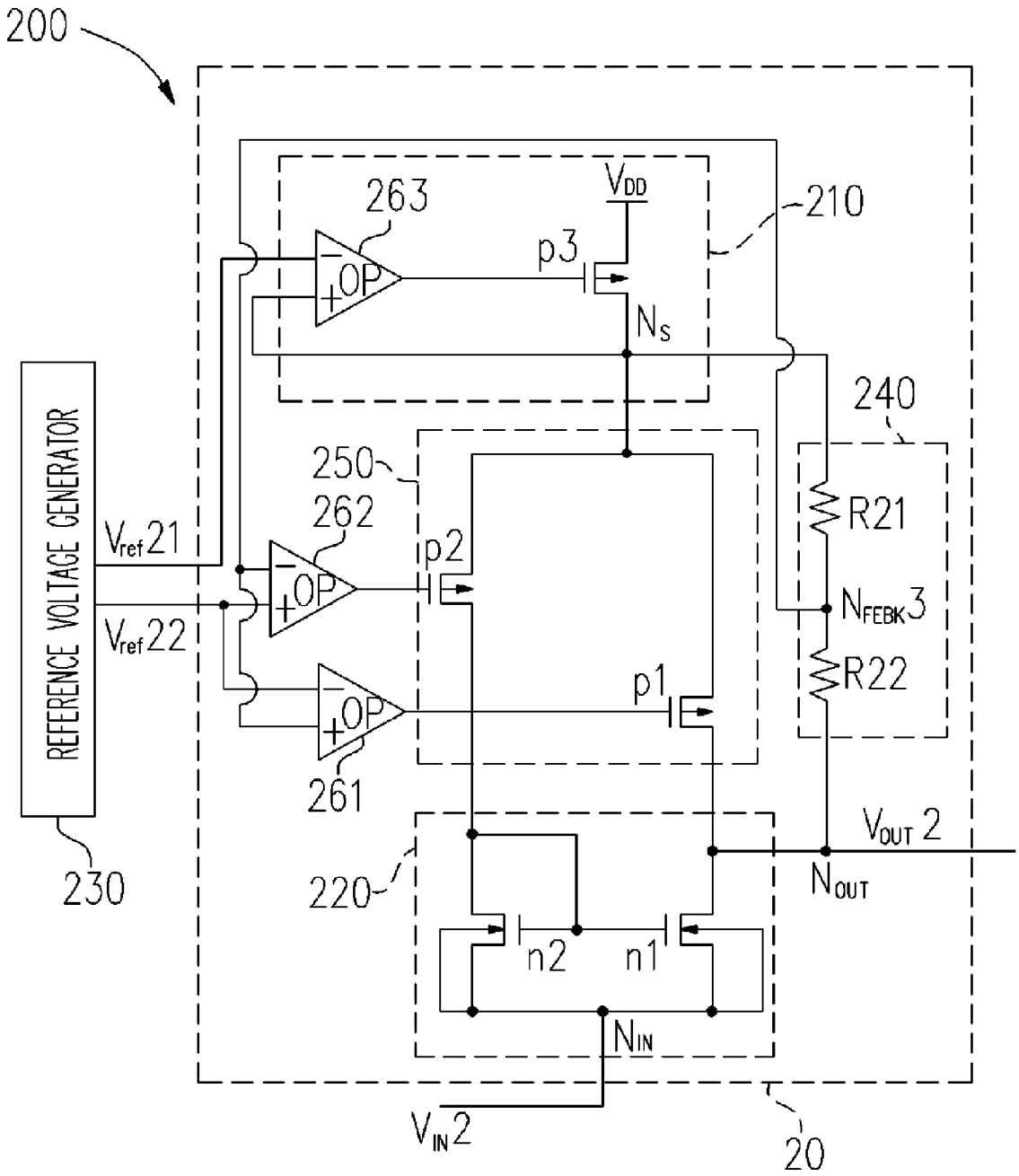
FIG. 2 (PRIOR ART)
FIG. 2 is a circuit diagram of a negative voltage regulator.
Figure 3:
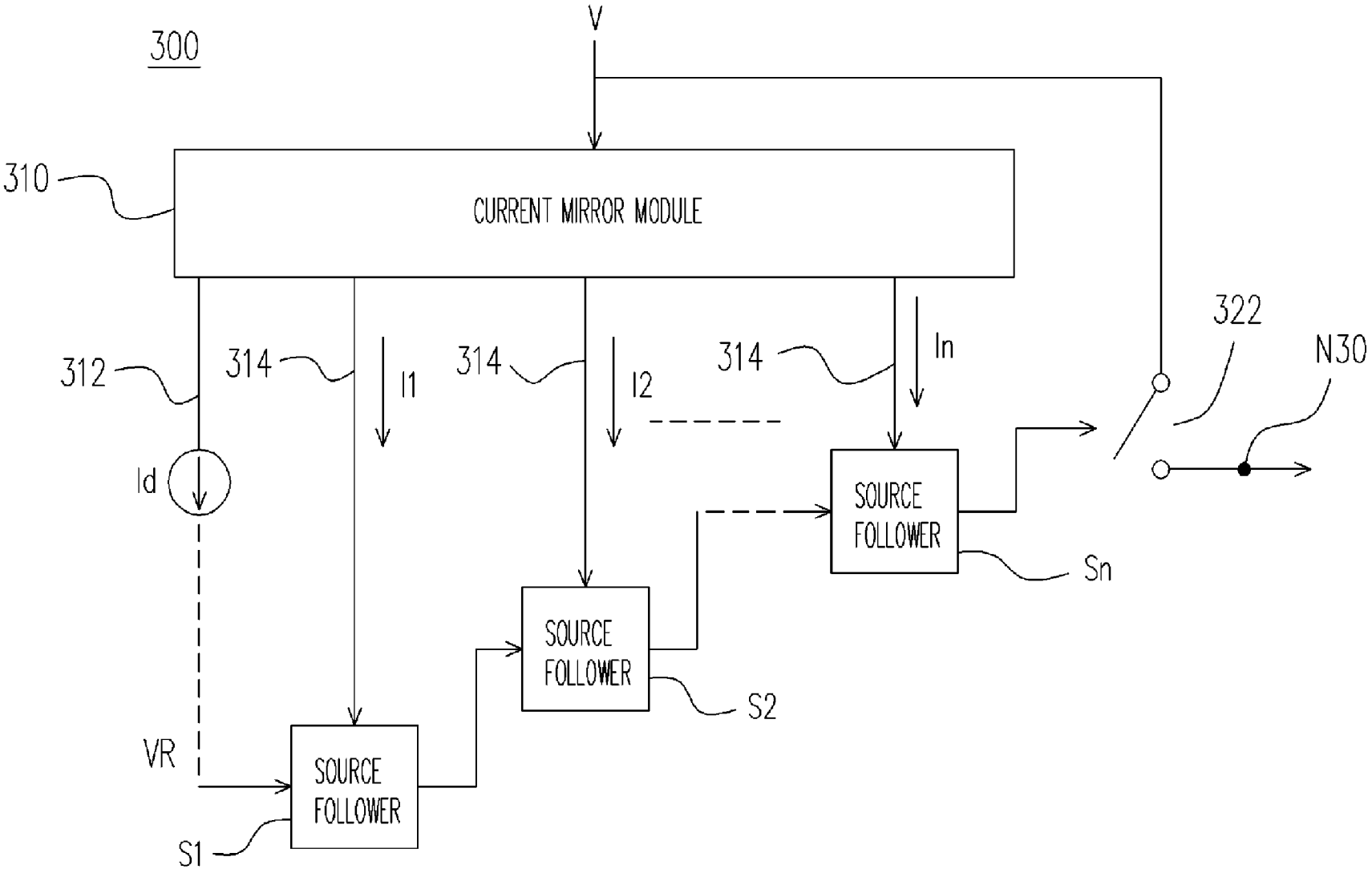
FIG. 3 is a circuit block diagram of a regulator circuit according to one preferred embodiment of the present invention.

FIG. 3 is a circuit block diagram of a regulator circuit according to one preferred embodiment of the present invention. Referring to FIG. 3, a regulator circuit 300 provided by the present invention comprises a current mirror module 310 coupled to a driving voltage V. The current mirror module 310 has a first current terminal 312 and a plurality of second terminals 314. Wherein, the first current terminal 312 is coupled to a driving current Id, and the driving current Id is copied to each second current terminal 314 as currents I1, I2, and In.

The regulator circuit 300 further comprises a plurality of source followers S1~Sn. In the present embodiment, each source follower receiver is coupled to one of the second current terminals respectively to receive corresponding copied driving currents I1~In. An output terminal of each source follower is coupled to an input terminal of next source follower. In addition, the input terminal of the first source follower S1 receives a control voltage VR.

A switch 322 is configured in the regulator circuit 300. The switch 322 is coupled to the driving voltage V and a voltage output terminal N30 of the regulator circuit 300. In the present embodiment, the source followers S1~Sn determine whether the switch 322 conducts the driving voltage V to the voltage output terminal N30 according to the control voltage VR and the copied driving currents I1~In.

In the preferred embodiment, each source follower can be formed by a NMOS transistor or a PMOS transistor. The following description will disclose two embodiments of the present invention.

Figure 4:
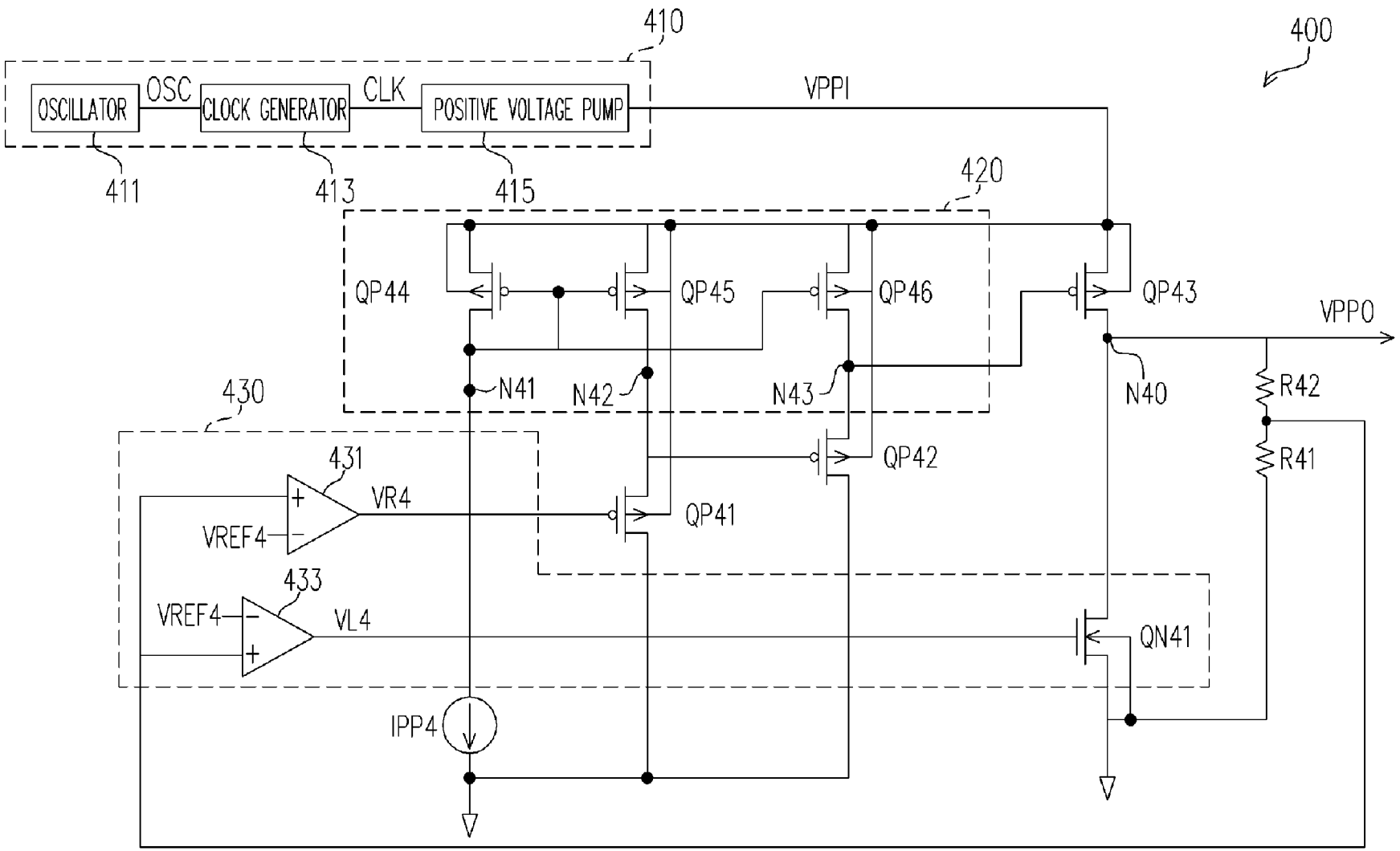
FIG. 4 is a circuit diagram of a regulator circuit according to the first embodiment of the present invention.

FIG. 4 is a circuit diagram of a regulator circuit according to the first embodiment of the present invention. Referring to FIG. 4, the present invention provides a regulator circuit 400 which includes a voltage output terminal N40, and the regulator circuit 400 includes a voltage source module 410, a current mirror module 420, an output module 430, and PMOS transistors QP41, QP42, and QP43. Wherein, the voltage source module 410 provides a driving voltage VPPI to the current mirror module 420, and the current mirror module 420 has current terminals N41, N42, and N43. Wherein the current terminal N41 is coupled to a driving current IPP4, and the driving current IPP4 is copied to the current terminals N42 and N43. In addition, the output module 430 is coupled to the voltage output terminal N40 and generates a control voltage VR4 and a control voltage VL4 according to an output voltage VPPO of the voltage output terminal N40. In addition, the source of the PMOS transistor QP41 is coupled to the current terminal N42, the drain thereof is grounded, and the gate thereof receives the control voltage VR4. The source of the PMOS transistor QP42 is coupled to the current terminal N43, the drain thereof is grounded, and the gate thereof is coupled to the source of the PMOS transistor QP41. Moreover, the source of the PMOS transistor QP43 receives the driving voltage VPPI, the gate thereof is coupled to the current terminal N43, and the drain thereof is coupled to the output module 430 and the voltage output terminal N40.

In an embodiment of the present invention, the output module includes operational amplifiers 431, 433 and a NMOS transistor QN41. Wherein, the operational amplifier 431 generates a control voltage VR4. The negative input terminal of the operational amplifier 431 receives a reference voltage VREF4, the output terminal thereof is coupled to the gate of the PMOS transistor QP41, and the positive input terminal thereof is grounded through a resistor R41 and to the voltage output terminal N40 through a resistor R42. Wherein the PMOS transistors QP41 and QP42 can be treated as source followers, i.e. common-drain amplifiers, and the voltage gain thereof is close to 1.

Meanwhile, the negative input terminal of the operational amplifier 433 receives the reference voltage VREF4, the positive input terminal thereof is coupled to the positive input terminal of the operational amplifier 431, and the output terminal thereof outputs the control voltage VL4. Besides, the gate of the NMOS transistor QN41 receives the control voltage VL4, the source thereof is grounded, and the drain thereof is coupled to the drain of the PMOS transistor QP43 and to the voltage output terminal N40.

In addition, in an embodiment of the present invention, the current mirror module includes PMOS transistors QP44, QP45, and QP46. Wherein, the source of the PMOS transistor QP44 receives a driving voltage VPPI, the gate and the drain thereof are coupled to the current terminal N41. The source and the gate of the PMOS transistor QP45 are respectively coupled to the source and the gate of the PMOS transistor QP44, and the drain thereof is coupled to the current terminal N42. The source and the gate of the PMOS transistor QP46 are respectively coupled to the source and the gate of the PMOS transistor QP44, and the drain thereof is coupled to the current terminal N43.

In addition, in an embodiment of the present invention, the voltage source module 410 includes an oscillator 411, a clock generator 413, and a positive voltage pump 415. Wherein the oscillator 411 generates an oscillating signal OSC, the clock generator 413 generates a clock signal CLK according to the oscillating signal OSC, and the positive voltage pump 415 generates the positive driving voltage VPPI according to the clock signal CLK.

As described above, the current mirror module 420 copies the driving current IPP4 passing through the current terminal N41 to the current terminals N42 and N43. Here, the regulator circuit 400 generates the output voltage VPPO at the output terminal N40 while the voltage source module 410 generates the driving voltage VPPI. Next, the output voltage VPPO is sent to the positive input terminal of the operational amplifier 431 after being divided by the resistors R41 and R42.

Here, the operational amplifier 431 compares the reference voltage VREF4 with the voltage level of the positive input terminal and outputs the control voltage VR4 to the gate of the PMOS transistor QP41. Since the PMOS transistor QP41 is coupled as a source follower, the PMOS transistor QP41 sends the control voltage VR4 to the PMOS transistor QP42. Similarly, the PMOS transistor QP42 is also coupled as a source follower; thus, the control voltage VR4 is further sent to the PMOS transistor QP43 and the PMOS transistor QP43 is driven.

The control voltage VR4 increases gradually while the output voltage VPPO increases gradually. However, since the transistor QP43 is a PMOS transistor, the output voltage VPPO is not affected. In addition, since the source followers formed by the PMOS transistors QP41 and QP42 are used for separating the voltage output terminal N40 from the control voltage VR4 of the operational amplifier 431, the range of the output voltage VPPO is determined by the driving voltage VPPI rather than limited by the operational amplifiers 431 and 433.

Figure 5:
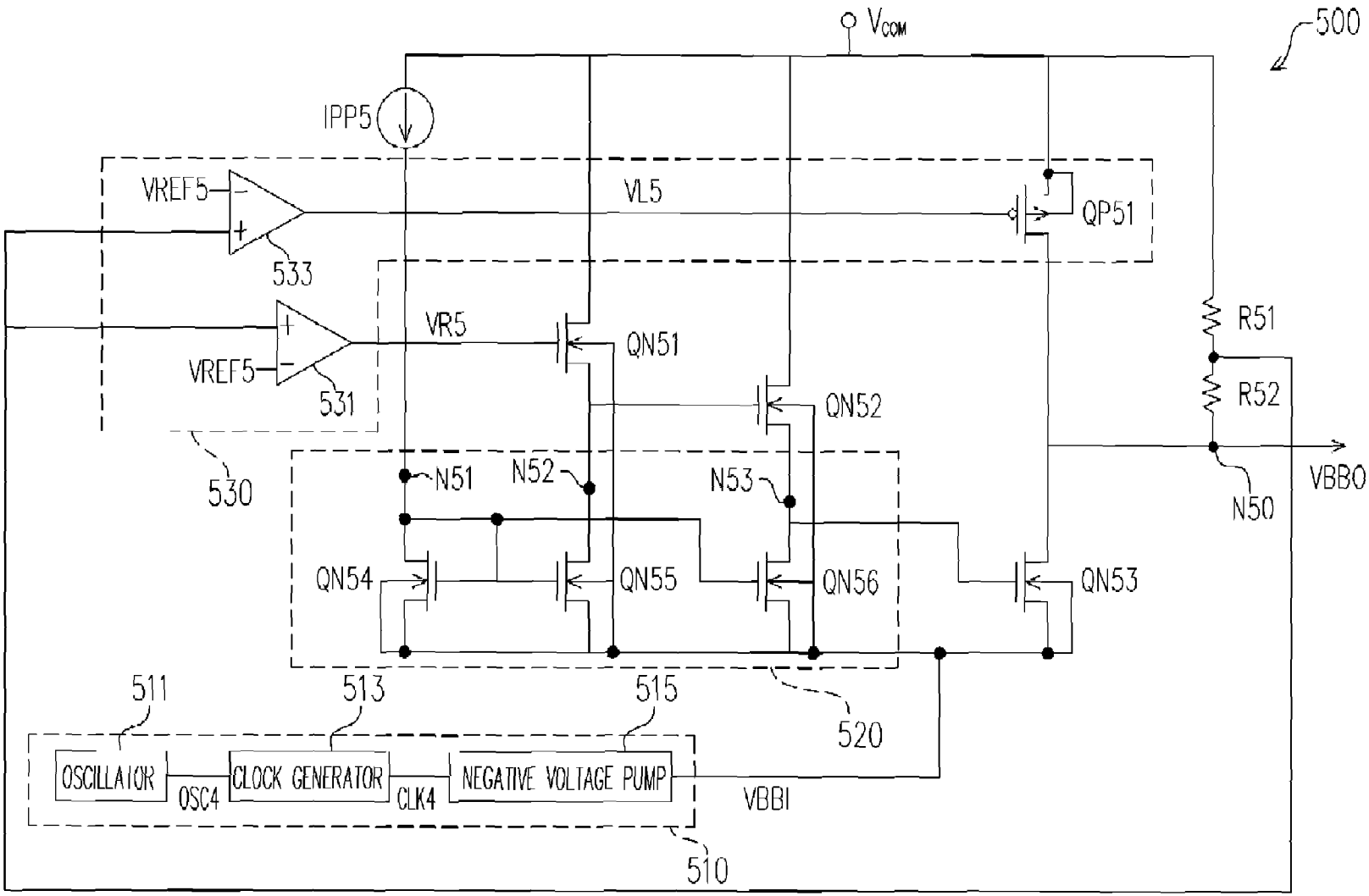
FIG. 5 is a circuit diagram of the regulator circuit according to another embodiment of the present invention.

FIG. 5 is a circuit diagram of a regulator circuit according to the second embodiment of the present invention. Referring to FIG. 5, the present invention further provides a regulator circuit 500 having a voltage output terminal N50, and the regulator circuit 500 includes a voltage source module 510, a current mirror module 520, an output module 530, and NMOS transistors QN51, QN52, and QN53. Wherein, the voltage source module 510 provides a negative driving voltage VBBI, and the current mirror module 520 receives the driving voltage VBBI. The current mirror module 520 has current terminals N51, N52, and N53, wherein the current terminal N51 receives a driving current IPP5, and the driving current IPP5 is copied to the current terminals N52 and N53. The output module 530 is coupled to the voltage output terminal N50 and generates control voltages VR5 and VL5 according to an output voltage VBBO of the voltage output terminal N50. The drain of the NMOS transistor QN51 is coupled to the common voltage $V_{COM}$, the gate thereof receives the control voltage VR5, and the source thereof is coupled to the current terminal N52. The drain of the NMOS transistor QN52 is coupled to the common voltage $V_{COM}$, the source thereof is coupled to the current terminal N53, and the gate thereof is coupled to the source of the NMOS transistor QN51 and to the current terminal N52. The source of the NMOS transistor QN53 receives the driving voltage VBBI, the gate thereof is coupled to the current terminal N53, and the drain thereof is coupled to the output module 530 and the voltage output terminal N50.

In the present embodiment, the output module 530 of the regulator circuit 500 includes operational amplifiers 531, 533 and a PMOS transistor QP51. Wherein, the operational amplifier 531 generates the control voltage VR5. The negative input terminal of the operational amplifier 531 receives a reference voltage VREF5, the output terminal thereof is coupled to the gate of the NMOS transistor QN51, and the positive input terminal thereof is coupled to the common voltage $V_{COM}$ through the resistor R51 and to the voltage output terminal N50 through the resistor R52. The negative input terminal of the operational amplifier 533 receives the reference voltage VREF5, the positive input terminal thereof is coupled to the positive input terminal of the operational amplifier 531, and the output terminal thereof outputs the control voltage VL5. The gate of the PMOS transistor QP51 receives the control voltage VL5, the source thereof is coupled to the common voltage $V_{COM}$, the drain thereof is coupled to the drain of the NMOS transistor QN53 and to the voltage output terminal N50. Wherein the NMOS transistors QN51 and QN52 can be treated as source followers, i.e. common-drain amplifiers, and the voltage gain thereof is close to 1.

On the other hand, the current mirror module 520 includes NMOS transistors QN54, QN55, and QN56. Wherein, the source of the NMOS transistor QN54 is coupled to the driving voltage VBBI, and the gate and the drain thereof are coupled to the current terminal N51. The source and the gate of the NMOS transistor QN55 are respectively coupled to the source and the gate of the NMOS transistor QN54, and the drain of the NMOS transistor QN55 is coupled to the current terminal N52. Moreover, the source and the gate of the NMOS transistor QN56 are respectively coupled to the source and the gate of the NMOS transistor QN54, and the drain of the NMOS transistor QN56 is coupled to the current terminal N53.

In addition, in another embodiment of the present invention, the voltage source module 510 of the regulator circuit 500 includes an oscillator 511, a clock generator 513, and a negative voltage pump 515. Wherein the oscillator 511 generates an oscillating signal OSC4, the clock generator 513 generates a clock signal CLK4 according to the oscillating signal OSC4, and the negative voltage pump generates the negative driving voltage VBBI according to the clock signal CLK4.

Similar to the regulator circuit 400 described above, the current mirror module 520 copies the driving current IPP5 passing through the current terminal N51 to the current terminals N52 and N53. Here, the regulator circuit 500 generates the output voltage VBBO from the output terminal N50 while the voltage source module 510 generates the driving voltage VBBI. Next, the output voltage VBBO is sent to the positive input terminal of the operational amplifier 531 after being divided by the resistors R51 and R52.

Here, the operational amplifier 531 compares the reference voltage VREF5 with the voltage level of the positive input terminal and outputs the control voltage VR5 to the gate of the NMOS transistor QN51. Since the NMOS transistor QN51 is coupled as a source follower, the NMOS transistor QN51 sends the control voltage VR5 to the NMOS transistor QN52. Similarly, the NMOS transistor QN52 is also coupled as a source follower; thus, the control voltage VR5 is further sent to the NMOS transistor QN53 and the NMOS transistor QN53 is driven.

The absolute value of the control voltage VR5 decrease gradually while the absolute value of the output voltage VBBO increases gradually. However, since the transistor QN53 is a NMOS transistor, the output voltage VBBO is not affected. In addition, since the source followers formed by the NMOS transistors QN51 and QN52 are used for separating the voltage output terminal N50 from the control voltage VR5 of the operational amplifier 531, the range of the output voltage VBBO is determined by the driving voltage VBBI rather than limited by the operational amplifiers 531 and 533.

According to the embodiments described above, referring to FIG. 4, in the regulator circuit 400 of the present invention, the changing driving voltage VPPI can be regulated to generate the stable output voltage VPPO. Meanwhile, since the source followers formed by transistors QP41 and QP42 are used, the maximum output voltage of the operational amplifier 431 in the output module 430 can reach VPPI. Accordingly, the range of the output voltage VPPO is improved, so that it is possible to supply stable output voltage with a wide range while erasing or other operations to non-volatile memory is performed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A regulator circuit having a voltage output terminal, the regulator circuit comprising:

a current mirror module, receiving a driving voltage and comprising a first current terminal and a plurality of second output terminals, wherein the first current terminal is coupled to a driving current, and the driving current is copied to each second current terminal;

a plurality of source followers, coupled to the second current terminal for receiving the copied driving current, and an output terminal of each source follower being coupled to an input terminal of next source follower as well as the input terminal of the first source follower receiving a control voltage; and a switch for determining whether the driving voltage is being conducted to the voltage output terminal or not according to the output of the last of the source followers.

2. The regulator circuit as claimed in claim 1, wherein each source follower has a transistor, a drain coupled to ground, a source coupled to one of the second current terminals and also coupled to a gate of the transistor of next source follower, and the gate of the transistor of the first source follower receives the first control voltage.

3. The regulator circuit as claimed in claim 2, wherein the transistors are PMOS transistors.

4. The regulator circuit as claimed in claim 2, wherein the transistors are NMOS transistors.

5. The regulator circuit as claimed in claim 1, wherein the switch circuit comprises a transistor, a source coupled to the driving voltage, a gate coupled to the output of the last source follower, and a drain coupled to the voltage output terminal.

6. A regulator circuit having a voltage output terminal, the regulator circuit comprising:

a voltage source module, used for providing a driving voltage;

a current mirror module, receiving the driving voltage and comprising a first current terminal, a second current terminal, and a third current terminal, wherein the first current terminal is coupled to a driving current, and the driving current is copied to the second and the third current terminals;

an output module, being coupled to the voltage output terminal and generating a first control voltage and a second control voltage according to the voltage level of the voltage output terminal;

a first PMOS transistor, the source of the first PMOS transistor being coupled to the second current terminal, the drain of the first PMOS transistor being grounded, and the gate of the first PMOS transistor receiving the first control voltage;

a second PMOS transistor, the source of the second PMOS transistor being coupled to the third current terminal, the drain of the second PMOS transistor being grounded, and the gate of the second PMOS transistor being coupled to the source of the first PMOS transistor; and a third PMOS transistor, the source of the third PMOS transistor receiving the driving voltage, the gate of the third PMOS transistor being coupled to the third current terminal, and the drain of the third PMOS transistor being coupled to the output module and the voltage output terminal.

7. The regulator circuit as claimed in claim 6, wherein the output module comprises:

a first operational amplifier, used for generating the first control voltage, a negative input terminal of the first operational amplifier receiving a reference voltage, an output terminal of the first operational amplifier being coupled to the gate of the first PMOS transistor, and a positive input terminal of the first operational amplifier being grounded through a first resistor and to the voltage output terminal through a second resistor, a second operational amplifier, a negative input terminal of the second operational amplifier receiving the reference voltage, a positive input terminal of the second operational amplifier being coupled to the positive input terminal of the first operational amplifier, and an output terminal of the second operational amplifier outputting the second control voltage; and a NMOS transistor, the gate of the NMOS transistor receiving the second control voltage, the source of the NMOS transistor being grounded, and the drain of the NMOS transistor being coupled to the drain of the third PMOS transistor and to the voltage output terminal.

8. The regulator circuit as claimed in claim 6, wherein the current mirror module comprises:

a fourth PMOS transistor, the source of the fourth PMOS transistor receiving the driving voltage, and the gate and the drain of the fourth PMOS transistor being coupled to the first current terminal;

a fifth PMOS transistor, the source and the gate of the fifth PMOS transistor being respectively coupled to the source and the gate of the fourth PMOS transistor, the drain of the fifth PMOS transistor being coupled to the second current terminal; and a sixth PMOS transistor, the source and the gate of the sixth PMOS transistor being respectively coupled to the source and the gate of the fourth PMOS transistor, and the drain of the sixth PMOS transistor being coupled to the third current terminal.

9. The regulator circuit as claimed in claim 6, wherein the voltage source module comprises:

an oscillator, used for generating an oscillating signal;

a clock generator, for generating a clock signal according to the oscillating signal; and a positive voltage pump, for generating the driving voltage according to the clock signal.

10. The regulator circuit as claimed in claim 6, wherein the driving voltage is a positive voltage.

11. A regulator circuit, having a voltage output terminal, the regulator circuit comprising:

a voltage source module, used for providing a driving voltage;

a current mirror module, receiving the driving voltage and having a current input terminal, a second current terminal, and a third current terminal, wherein the current input terminal receives a driving current, and the driving current is copied to the second and the third current terminals;

an output module, being coupled to the voltage output terminal, generating a first control voltage and a second control voltage according to the voltage level of the voltage output terminal;

a first NMOS transistor, the drain of the first NMOS transistor being coupled to a common voltage, the gate of the first NMOS transistor receiving the first control voltage, and the source of the first NMOS transistor being coupled to the second current terminal;

a second NMOS transistor, the drain of the second NMOS transistor being coupled to the common voltage, the source of the second NMOS transistor being coupled to the third current terminal, and the gate of the second NMOS transistor being coupled to the source of the first NMOS transistor and to the second current terminal; and a third NMOS transistor, the source of the third NMOS transistor receiving the driving voltage, the gate of the third NMOS transistor being coupled to the third current terminal, and the drain of the third NMOS transistor being coupled to the output module and the voltage output terminal.

12. The regulator circuit as claimed in claim 11, wherein the output module comprises:

a first operational amplifier, used for generating the first control voltage, a negative input terminal of the first operational amplifier receiving a reference voltage, an output terminal of the first operational amplifier being coupled to the gate of the first NMOS transistor, and a positive input terminal of the first operational amplifier being coupled to the common voltage through a first resistor and to the voltage output terminal through a second resistor;

a second operational amplifier, a negative input terminal of the second operational amplifier receiving the reference voltage, a positive input terminal of the second operational amplifier being coupled to the positive input terminal of the first operational amplifier, and an output terminal of the second operational amplifier outputting the second control voltage; and a PMOS transistor, the gate of the PMOS transistor receiving the second control voltage, the source of the PMOS transistor being coupled to the common voltage, and the drain of the PMOS transistor being coupled to the drain of the third NMOS transistor and to the voltage output terminal.

13. The regulator circuit as claimed in claim 11, wherein the current mirror module comprises:

a fourth NMOS transistor, the source of the fourth NMOS transistor being coupled to the driving voltage, the gate and the drain of the fourth NMOS transistor being coupled to the first current terminal;

a fifth NMOS transistor, the source and the gate of the fifth NMOS transistor being respectively coupled to the source and the gate of the fourth NMOS transistor, the drain of the fifth NMOS transistor being coupled to the second current terminal; and a sixth NMOS transistor, the source and the gate of the sixth NMOS transistor being respectively coupled to the source and the gate of the fourth NMOS transistor, the drain of the sixth NMOS transistor being coupled to the third current terminal.

14. The regulator circuit as claimed in claim 11, wherein the voltage source module comprises:

an oscillator, used for generating an oscillating signal;

a clock generator, generating a clock signal according to the oscillating signal; and a negative voltage pump, generating the driving voltage according to the clock signal.

15. The regulator circuit as claimed in claim 11, wherein the driving voltage is a negative voltage.

* * * * *